United States Patent [19]

Wong et al.

[11] 4,324,291

[45] Apr. 13, 1982

[54] VISCOUS OIL RECOVERY METHOD

[75] Inventors: Kenny Wong, Houston; Wilbur L. Hall, Bellaire, both of Tex.

[73] Assignee: Texaco Inc., White Plains, N.Y.

[21] Appl. No.: 144,732

[22] Filed: Apr. 28, 1980

[51] Int. Cl.[3] ..... E21B 43/24; E21B 47/06

[52] U.S. Cl. ..... 166/252; 166/272

[58] Field of Search ..... 166/272, 252, 303

[56] References Cited

U.S. PATENT DOCUMENTS

| | | | |
|---|---|---|---|
| 3,771,598 | 11/1973 | McBean | 166/272 X |
| 4,099,568 | 7/1978 | Allen | 166/272 X |
| 4,121,661 | 10/1978 | Redford | 166/272 X |
| 4,127,170 | 11/1978 | Redford | 166/272 X |
| 4,127,172 | 11/1978 | Redford et al. | 166/272 |
| 4,130,163 | 12/1978 | Bombardieri | 166/272 X |
| 4,133,382 | 1/1979 | Cram et al. | 166/272 X |

*Primary Examiner*—Stephen J. Novosad
*Assistant Examiner*—George A. Suchfield
*Attorney, Agent, or Firm*—Carl G. Ries; Robert A. Kulason; Jack H. Park

[57] ABSTRACT

Disclosed is an improved viscous oil recovery method employing the injection of a thermal recovery fluid which may be steam or a mixture of steam and additives, and cycles of pressurization and drawdown. First the thermal recovery fluid is injected and production is restricted in order to increase the pressure in the reservoir. Injection is then terminated or decreased and production is increased in order to effect a pressure drawdown in the reservoir. Thereafter the production rate is decreased or production wells are shut in completely and non-condensable gas is injected to raise the pressure in the reservoir to a value which is from 50 to 90 percent of the final target pressure, after which the thermal recovery fluid is again injected into the formation to rebuild reservoir pressure with restricted production. Finally, production rate is increased and thermal recovery fluid injection is reduced or terminated in order to accomplish another reservoir drawdown cycle. Additional cycles of partial repressuring with non-condensable gas followed by steam injection followed by pressure drawdown production cycles may be employed.

20 Claims, 1 Drawing Figure

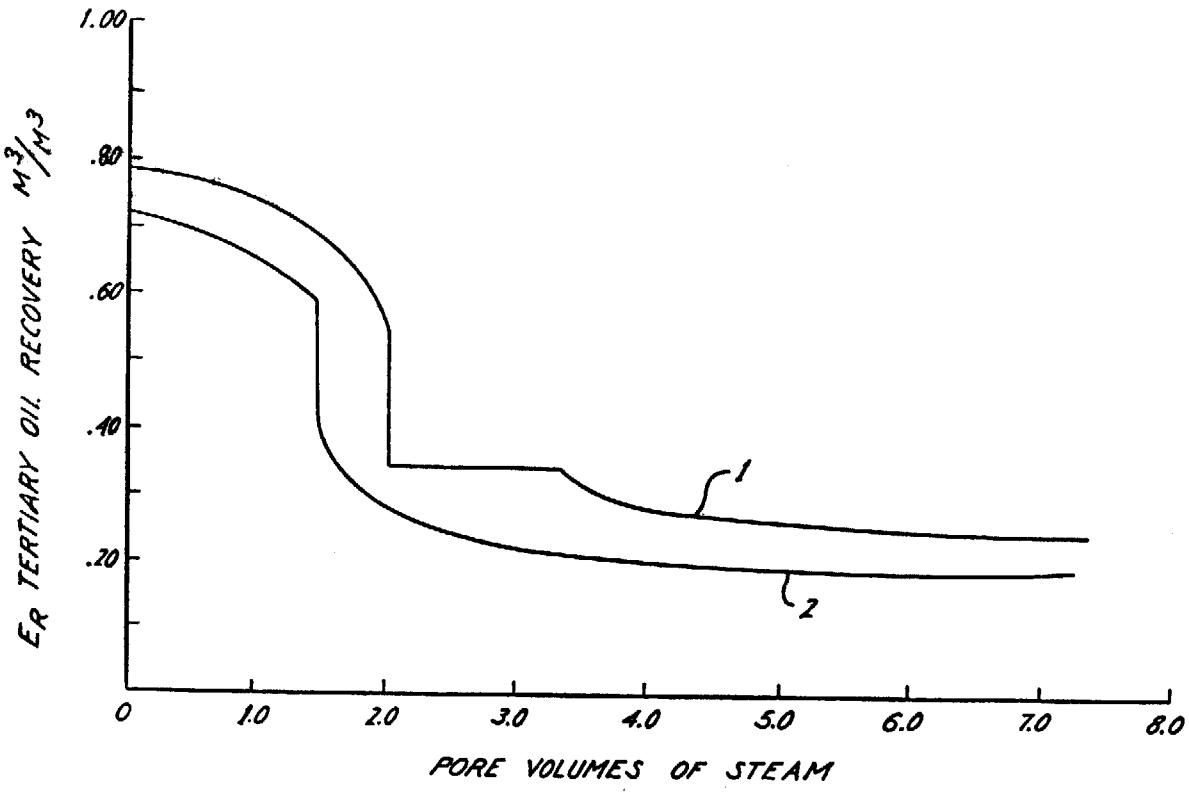
1.00
.80
.60
.40
.20
0
1.0
2.0
3.0
4.0
5.0
6.0
7.0
8.0
1
2
ER TERTIARY OIL RECOVERY M3/M3
PORE VOLUMES OF STEAM

VISCOUS OIL RECOVERY METHOD

FIELD OF THE INVENTION

This invention pertains to an oil recovery method, and more particularly to a method for recovering viscous oil or viscous petroleum from subterranean deposits. Still more particularly, this method employs steam injection with alternate pressurization and drawdown cycles.

DESCRIPTION OF THE PRIOR ART

It is well known and documented in the prior art that there are viscous petroleum-containing deposits located throughout the world from which petroleum cannot be recovered by conventional means because the petroleum contained therein is so viscous that it is essentially immobile at formation temperature and pressure. Tar sand deposits such as those located in Western United States, Northern Alberta, Canada, and in Venezuela are extreme examples of such viscous petroleum-containing deposits.

The prior art includes many references to the use of thermal recovery fluids including steam as well as mixtures of steam and many additives. While petroleum can be recovered economically from viscous petroleum-containing formations, the percentage of the oil originally present in the viscous oil formations that can be recovered by simple steam flooding is frequently disappointing, and there is a significant need for methods for recovering increased percentages of the total amount of viscous oil present in the formations.

Numerous prior art references describe variations in the steam flood process in which first steam is injected under conditions which cause an increase in reservoir pressure, followed by rapid production of petroleum and other fluids to cause a reduction in the reservoir pressure. These processes increase the volume of formation from which viscous oil is recovered as a consequence of the pressurization and drawdown as compared to the volume for which production is obtained in a conventional throughput steam drive process. These processes represent a significant improvement in the amount of viscous oil that can be recovered from a formation by steam flooding.

While the foregoing pressurization drawdown processes increase the amount of oil production, there is still a need for improving the overall thermal efficiency of steam drive processes, since substantial amounts of the produced oil must be burned to generate steam for steam flooding. It has been noted in connection with the steam injection pressurization drawdown process that after the first and subsequent drawdown cycles, a substantial amount of steam had to be injected into the reservoir to repressure it before significant petroleum production is resumed. The injection of steam into a reservoir for repressuring when little or no additional oil production is occurring substantially increases the total cost of steam.

There is a great need for a method to increase the amount of oil being recovered from formations by steam flooding, and/or to decrease the amount of steam which must be injected to accomplish oil recovery. There is also a need for decreasing the time required to deplete a viscous oil formation to a constant level.

DISCUSSION OF THE PRIOR ART

Canadian Pat. GS 1,004,593 describes an oil recovery method comprising a single steam injection pressurization program sufficient in which steam is injected to pressure for formation to a very high level, followed by a soak period followed by rapid production of fluids from the formation.

U.S. Pat. No. 3,155,160 describes a single well push pull steam injection process involving alternate pressurization and production cycles to maintain pressure in the ever expanding cavity created adjacent to the well by the oil recovery process.

U.S. Pat. No. 4,121,661 describes a method for recovering viscous petroleum by a method employing a plurality of cycles of steam injection-pressurization and drawdown cycles.

U.S. Pat. No. 4,127,172 describes a low temperature controlled oxidation process comprising injecting a mixture of steam and a free-oxygen containing gas into the formation in combination with a plurality of pressurization and drawdown cycles for recovering viscous petroleum.

U.S. Pat. No. 4,127,170 describes a viscous oil recovery process comprising injecting steam and hydrocarbons into the formation in combination with pressurization and drawdown cycles.

SUMMARY OF THE INVENTION

We have discovered a method for recovering viscous petroleum from subterranean formations by a process which reduces the total amount of steam required, increases the total oil recovery, and accomplishes final recovery sooner than is possible using prior art methods. This method comprises recovering viscous petroleum from subterranean, viscous petroleum formations penetrated by at least one injection well and by at least one production well, and injecting a thermal recovery fluid namely steam into the formation via the injection well and recovering fluid from the production well while restricting the flow rate of fluids from the production well to a value less than 50 percent of the fluid injection rate into the injection well in order to increase the pressure in the formation. This is followed by a pressure depletion cycle in which fluids are recovered from the production well at a high rate and little or no fluid injection occurs at the injection well until the formation pressure adjacent the production well has dropped to a predetermined percentage of the fluid injection pressure of the first cycle. The formation is then repressurized by injecting a non-condensable gas into the formation at a high rate with little or no production of fluids occurring from the production well, until the pressure in the formation adjacent the injection well has been raised to a value which is from 50 to 90 percent and preferably from 60 to 80 percent of the final desired pressure, after which the thermal recovery fluid injection is resumed with restricted production in order to complete the second repressurization stage. Repeated cycles of production in which pressure drawdown is followed by partial repressurization and steam injection to a final pressure value are applied until the desired oil production rate can no longer be obtained from the formation. Suitable inert gases for use in our process include nitrogen, air, low molecular weight gaseous hydrocarbons such as methane, ethane, or propane as well as natural gas which comprises a mixture of methane and other gaseous hydrocarbons, carbon dioxide, as well as flue gas or exhaust gas which comprises a mixture of carbon dioxide, nitrogen and other gases. The thermal recovery fluid may be substantially pure steam, or a mixture of steam and hydrocarbons. Steam and air in a controlled ratio may be applied to accomplish a low-temperature oxidation reaction in the viscous oil formation.

In another, preferred embodiment, a preliminary heating step is applied to the formation prior to the first pressurization with curtailed production to accomplish formation pressure increase. This heating step comprises injecting the thermal recovery fluid, e.g. steam alone or steam and the additive described herein, into the formation and unrestrained production of fluids from the formation as a preliminary heating step. Some oil production will result from this step, but the primary purpose is to preheat at least a portion of the formation prior to the commencing of the first steam injection pressurization cycle. This is conveniently continued until the temperature of the fluids being recovered from the production well increases to a value near steam temperature, or it may be continued until live steam production is observed at the production well.

BRIEF DESCRIPTION OF THE DRAWINGS

The attached drawing illustrates the change in oil saturation in a laboratory cell packed with tar sand material when a conventional, prior art steam pressurization and drawdown method is applied. It also depicts the change in oil saturation with the process as conducted according to the present invention using partial repressurization with inert gas.

DESCRIPTION OF THE PREFERRED EMBODIMENTS

The process of our invention is best applied to a subterranean, viscous oil-containing formation such as a tar sand deposit in which there exists an adequate natural permeability to steam and other fluids, or in which a suitable communication path or zone of high fluid transmisibility is formed prior to the application of the main portion of the process of our invention. Our process may be applied to a formation with as little as two spaced-apart wells both of which are in fluid communication with the formation, and one of which is completed as an injection well and one of which is completed as a production well. Ordinarily optimum results are attained with the use of more than two wells, and it is usually preferably to arrange the wells in some pattern as is well known in the art of oil recovery, such as a five spot pattern in which an injection well is surrounded with four production wells, or in a line drive arrangement in which a series of aligned injection wells and a series of aligned production wells are utilized, for the purpose of improving horizontal sweep efficiency.

If it is determined that the formation possesses sufficient initial or naturally-occurring permeability that steam and other fluids may be injected into the formation at a satisfactory rate and pass therethrough to spaced-apart wells without danger of plugging or other fluid flow-obstructing phenomena occuring, the process to be described below may be applied without any prior treatment of the formation. Frequently, the permeability of viscous oil-containing formations is not sufficient to allow direct application of the process of this invention, and particularly in the case of tar sand deposits it may be necessary first to apply some process for the purpose of gradually increasing the permeability of all or some portion of the formation such that well-to-well communication is established. Many such methods are described in the literature, and include fracturing with subsequent treatment to expand the fractures to form a well-to-well communication zone by injecting aqueous emulsifying fluids or solvents into one or both of the wells to enter the fracture zones in a repetitive fashion until adequate communication between wells is established. In some instances it is sufficient to inject a non-condensable gas such as air, nitrogen or a gaseous hydrocarbon such as methane into one well and produce fluids from a remotely located well until mobile liquids present in the formation have been displaced and a gas swept zone is formed, after which steam may be injected safely into the previously gas swept zone without danger of plugging the formation. Plugging is thought to occur in steam injection because viscous petroleum mobilized by the injected steam forms an oil bank, and moves away from the steam bank into colder portions of the formations, thereafter cooling and becoming immobile at a point remote from the place in the formation in which steam is being injected, thus preventing further fluid flow through the plugged portion of the formation. Unfortunately, once the bank of immobile bitumen has cooled sufficiently to become immobile, subsequent treatment is precluded since steam or other fluids which would be capable of mobilizing the bitument cannot be injected through the plugged portion of the formation to contact the occluding materials, and so that portion of the formation may not be subjected to further oil recovery operations. Accordingly, the step of developing well-to-well communications is an exceedingly important one in this or any other process involving injection of heated fluids such as steam into low permeability viscous oil formations, especially tar sand deposits.

To the extent the horizontal location of the communication channel can be controlled, such as in the instance of fracturing and expanding the fractured zone into the communication path between spaced apart wells, it is preferable that the communication path be located in the lower portion of the formation, preferably at the bottom thereof. This is desired since the heated fluid will have the effect of mobilizing viscous petroleum in the portion of the formation immediately above the communication path, and will drain downward to the heated, high permeability communication path where the viscous petroleum is easily displaced toward the petroleum well. It has been found to be easier to strip viscous petroleum from a portion of a formation located above the communication path than to strip viscous petroleum from the portion of the formation located below the communication path.

The process of this invention comprises a series of cycles, with the first cycle consisting of at least the following parts.

Either saturated or superheated steam may be used for the thermal recovery fluid in this process. The preferred steam quality is from 75% to about 95%. Additive may be incorporated in the steam as will be explained below.

In the first step of the process of our invention, the thermal recovery fluid is injected into the formation and production is taken from the production well, but the injection rate is maintained at a value greater than the production rate in order to increase the pressure within the portion of the formation being effected by the thermal recovery process.

The pressure at which the thermal recovery fluid is injected into the formation is limited by the pressure at which fracture of the overburden above the formation would occur since the injection pressure must be maintained below the overburden fracture pressure. Alternately, the maximum allowable pressure of the steam generation equipment available for the oil recovery operation, if less than the fracture pressure, may set the maximum injection pressure. It is usually preferred that the thermal recovery fluid be injected at the maximum flow rate possible and at the maximum safe pressure consistent with the foregoing limitations. The actual rate of fluid injection is determined by injection pressure and formation permeability and the thermal recovery fluid is injected at the maximum attainable rate at the maximum safe pressure. The injection rate should be measured.

The optimum degree to which the flow of fluids from production wells is restricted or throttled can be ascertained in a number of ways. It is sometimes sufficient to reduce the flow rate to attain the maximum fluid production that can be accomplished without production of any vapor-phase steam. Ideally the pressure in or adjacent to the production well should be monitored, and the flow of fluids from the production well should be restricted to less than 50 and preferably less than 20 percent of the injection rate. This maintains fluid flow through the channel and still causes the pressure in the flow channel to increase. This procedure is continued until the pressure in the formation adjacent the production well rises to a value from 60 to 95% and preferably at least 80% of the pressure at which the thermal recovery fluid is being injected into the injection well. Preferably, a "flowing bottom hole pressure test" such as is commercially available in oil field operation, should be employed for this purpose. This is described on page 59 of "Primer of Oil and Gas Production" published by the American Petroleum Institute. For example, if the thermal recovery fluid injection pressure is 400 pounds per square inch, the fluid flow rate at the production well should be throttled as described above until the pressure in the formation adjacent the production well has risen to a value of at least 240 pounds per square inch and preferably at least 320 pounds per square inch (60 to 80% of the injection pressure). Ordinarily the pressure will increase gradually as the formation pressure is increased due to the unrestricted fluid injection and severely restricted fluid flow from the production well; therefore only near the end of the second part of the cycle will the pressure at the production well approach the levels discussed above.

Another method of determining when the second part of the cycle should be terminated involves measuring the temperature of the fluids being produced from the production well, and ending the second part of the cycle when the produced fluid temperature approaches the saturation temperature of steam at the pressure in the formation adjacent the production well. This can be detected at the end of the second part of the cycle by the production of a small amount of vapor phase steam or live steam from the production well.

When the next part of the cycle is initated, both injection and production procedures are changed dramatically. The restriction to fluid flow from the production well is removed and the maximum safe fluid flow rate is desirable from the production wells. That is to say, the fluid flow from the production well should be choked only if and to the degree required to protect the production equipment and for safe operating practices. At the same time, the injection rate of thermal oil recovery fluid is reduced to a very low level, principally to prevent back flow of fluids from the formation into the injection well. Ordinarily the injection rate is reduced to a value less than 50% and preferably less than 20% of the original fluid injection rate. This insures that there will be a positive pressure gradient from the injection well to the production well at all times, and also permits the maximum effective use of the highly beneficial drawdown portion of the cycle.

The drawdown portion of the cycle is continued so long as fluid continues to flow or can be pumped or lifted from the production well at a reasonable rate. Once the fluid flow rate has dropped to a value less than 50 percent and preferably less than 20 percent of the initial fluid flow rate of the production wells, the drawdown cycle may be terminated and repressurization should begin. It is at this point that the process of our invention departs significantly from the prior art teachings. Prior art references teach the desirability of pressurization as is described above, but teach subsequent repressurization cycles to be accomplished by immediately commencing steam injection after termination of the pressure drawdown cycle. We have found that a large amount of steam must be injected into the formation before oil production is initiated, and this requires both the expenditure of considerable amounts of fuel to generate the steam and necessitates a substantial waiting period before oil production begins. The time required to repressure the formation is mainly determined by the injectivity of the portion of the formation immediately adjacent to the injection well.

We have found, and this constitutes our invention, that the first and subsequent repressurization cycles should be accomplished by injecting substantially pure noncondensable gas into the formation. The gas may be heated or it may be comingled with steam, but it is sufficient if the next step after the first drawdown is simply injecting a noncondensable gas into the formation at the highest injection rate possible without exceeding the safety guidelines of the formation and injection equipment. The pressure in the formation immediately adjacent to the injection well should be monitored, and the endpoint for conclusion of this step is the pressure rather than the total volume of gas injected. Gas injection should be terminated and steam injection initiated when the pressure in the formation adjacent the injection well has risen to a value from 50 to 90 percent and preferably from 60 to 80 percent of the final target formation pressure value.

After the above step of a partial repressurization of the formation with inert gas has been completed, injection of the thermal recovery fluid may be resumed. If steam alone is the thermal recovery fluid being employed, gas injection should be terminated and steam injection should be resumed, while continuing the restricted production, in order to finish pressurization of the formation prior to the next drawdown cycle. Steam injection will continue as is described above, until the end of the steam injection pressurization cycle is signaled, either by the value of the formation pressure adjacent the production well, or by the occurrence of vapor phase steam in the production well, or by the indication that the temperature of the fluid being produced from the production well is at the desired level. The next step will comprise the same restricted injection, unrestricted production for pressure drawdown as is described above.

Ordinarily, the final desired oil production from a given pattern will require the application of the first pressurization drawdown cycle and a plurality of the above described cycles comprising partial repressurization with inert gas followed by final pressurization with steam injection followed by high production rate pressure drawdown cycle.

In another, preferred embodiment, a preliminary heating step is applied to the formation prior to the first pressurization with curtailed production to accomplish formation pressure increase. This heating step comprises injecting the thermal recovery fluid, e.g. steam alone or steam and the additive described herein, into the formation and unrestrained production of fluids from the formation as a preliminary heating step. Some oil production will result from this step, but the primary purpose is to preheat at least a portion of the formation prior to the commencing of the first steam injection pressurization cycle. This is conveniently continued until the temperature of the fluids being recovered from the production well increases to a value near steam temperature, or it may be continued until live steam production is observed at the production well.

The inert gas to be employed in this process may be any readily available and inexpensive material which remains gaseous under formation and injection conditions. Condensable fluids should not be employed for this purpose, since the phase change of gas to liquid will cause a significant pressure drop within the formation adjacent the injection well, which defeats the desired purpose of raising the formation pressure to the target value as rapidly as possible. Nitrogen is an excellent inert gas for this purpose. It is not necessary that the gas injected be high purity, and it is frequently possible to obtain low purity gases at significantly lower costs than for high purity gas. Carbon dioxide, either in relatively pure state or the mixture of gases known as flue gases or exhaust gases may be used. Exhaust or flue gases are mixtures of carbon dioxide and nitrogen, with other contaminant level gases being present. Low molecular weight hydrocarbons may be employed for this inert gas repressurization step, provided they meet the general requirement that they be noncondensable at the conditions of the formation and at the injection pressure and temperature. Methane, or natural gas which is a mixture of methane and lesser quantities of normally gaseous hydrocarbons including ethane, propane, etc. are excellent materials for this purpose.

It is desired to accomplish repressurization of the formation while minimizing loss of heat or thermal energy from the formation. While it is often not worth the cost to raise the temperature of the injected inert gas by deliberately heating the same, many compressors employ after coolers whose purpose is the reduction in gas temperature by passing the compressed gas through a heat exchanger. It is preferable that after coolers not be used in the present process, since the additional thermal energy contained in high temperature, compressed gas will aid in maintaining the temperature in the formation in the desired range for efficient viscous oil recovery.

The process described herein may be employed in any thermal oil recovery method in which the thermal oil recovery fluid comprises a significant portion of steam. Substantially pure steam is a popular thermal oil recovery method, and one preferred embodiment of our invention employs steam, preferably steam in the range of 45 to 95 percent quality as the thermal oil recovery fluid without any additional additives. It is well known that additives may be mixed with steam and under certain conditions accomplish improved recovery. Accordingly, another preferred embodiment of our invention employs as the thermal recovery fluid in one or more thermal recovery fluid injection sequences, a mixture of hydrocarbons with steam. Specifically, $C_3$ to $C_{12}$ hydrocarbons including mixtures thereof, such as propane, butane, pentane, hexane, heptane, octane, nonane or decane, undecane and dodecane may be employed. Since the hydrocarbons when mixed with steam in this embodiment are employed as solvents, the higher molecular weight hydrocarbons within this preferred range are generally more effective and therefore preferable to the lower molecular weight hydrocarbons. This is opposite to the preferred low molecular weight normally gaseous hydrocarbons when used as the inert gas for repressurization. Paraffinic hydrocarbons may be employed, and commercially available mixtures such as natural gasoline, naphtha, kerosene, etc. are suitable solvents for this use. Aromatic hydrocarbons, either as a component in a mixture of hydrocarbons or in substantially pure form may be used in combination with steam as the thermal oil recovery fluid of this invention.

In yet another preferred embodiment, the thermal oil recovery fluid comprises a mixture of steam and a free oxygen-containing gas for the purpose of accomplishing a controlled, low temperature oxidation reaction. This may be in only a portion of or in all of the thermal oil recovery injection sequences described above. When used in this embodiment, the ratio of gas to steam should be from 0.05 to 0.65 thousand standard cubic feet or inert gas per barrel of steam (as water). This ratio is critical in order to insure that a controlled combustion rather than a high temperature oxidated reaction is accomplished.

In yet another embodiment, a low molecular weight amine or diamine is comingled with the steam in the ratio of from 0.1 to 10.0 percent by weight amine.

The above described process of our invention is continued with repetitive cycles being applied after the first cycle, comprising partial repressurization by injecting inert gas followed by injection of the thermal oil recovery fluid comprising steam with throttled production to accomplish pressurization of the formation to the desired final value, followed by the pressure depletion cycle which comprises high production rates with reduced injection rates to accomplish drawdown of accumulated reservoir pressure. These cycles are continued until the oil recovery efficiency begins to drop off as is evidenced by a reduction in the oil-water ratio of the produced fluids during the production pressure drawdown portion of the cycle.

EXPERIMENTAL SECTION

For the purpose of demonstrating the operability and optimum operating conditions of the process of our invention, the following experimental results are presented. The ones to be described below were performed in a laboratory cell which was packed with tar sand material obtained from the Great Canadian Oil Sand Mining Operation conducted near Ft. McMurray, Alberta, Canada. The tar sand material was packed into a laboratory cell which is equipped with an equivalent injection well and production well with related equipment to measure accurately the amount of steam injected and the volume of fluids recovered from the cell. In run 1, a test was conducted according to prior art teachings in which steam injection pressurization and drawdown was followed by repressurization with steam. This is designated as Curve 1 in the attached drawing, and it can be seen that excellent results are obtained using this technique. In the second run, the first cycle involved steam injection pressurization followed by a pressure drawdown production cycle such as is taught in the prior art. The next cycle was in accordance with our process, in which the cell was repressured by injecting nitrogen into the cell until the pressure reached a value of about 240 pounds per square inch, or 80 percent of the ultimate target value, after which steam injection was reinitiated to complete the repressurization stage, followed by another drawdown. The residual oil saturation in the cells at various values of cumulative fluid injection are illustrated in the attached figure. It can be seen that Run 1, conducted according to the prior art teachings for pressurization and drawdown steam flooding recovery processes accomplished significant production, and achieved a fairly low value of oil saturation after the pressure drawdown which occurred at about 2.0 pore volumes. The long flat portion of Curve 1 and between 2 and 3 pore volumes involves the step of repressuring with steam, and it can be seen that no reduction in oil saturation was accomplished during this period even though more than one full pore volume of steam was injected into the cell. Curve 2 illustrates the change in oil saturation versus pore volumes of steam injected when the repressurization was accomplished by injecting an inert gas according to our invention. The time required to achieve pressurization after cessation of inert gas injection at about 1.5 pore volumes of total steam injection was much lower, as is evidenced by the rapid continuation of the downward path of Curve 2, illustrating that additional oil is being recovered at a much lower value of repressurization steam injection than in the case of Run 1.

For comparison purposes, a series of runs performed using the above described experimental arrangement were compared. In a series of 5 runs using straight 300# steam displacement without pressure drawdown, the average residual oil saturation was 0.29. In four runs which employed steam with pressurization, drawdown and repressurization by steam injection only, the residual oil saturation averaged 0.23. In a run employing the process of this invention in which the first pressurization was with steam only, but repressuring after drawdown was with nitrogen injection until the cell pressure reached a predetermined value, followed by continuation of the steam pressurization and production, resulted in the final oil saturation of 0.19. Repressurizing the cell with steam rather than nitrogen requires approximately 32 percent more steam than is required using inert gas injection, where steam injection is resumed only after the cell pressure had been raised to a predetermined value.

The significant improvement when using pressurization and drawdowns in steam flooding is believed to be related to vaporization of certain fluid components of the formation, including connate water or water films on the formation sand grains as well as lower molecular weight hydrocarbons, including those injected as well as hydrocarbons which are naturally occurring in the formation. Vaporization of these materials results in a volume increase which provides the displacement energy necessary to force heated and/or diluted viscous petroleum from the portion of the formation above or below the communication path, into the communication path and subsequently through the communication path toward the production well where they may be recovered to the surface of the earth. It is also believed that the employment of the drawdown cycles, particularly when initiated early in the steam and hydrocarbon injection program, accomplish a periodic cleanout of the communication path whose transmissibility must be maintained if continued oil production is to be accomplished in any thermal oil recovery method. These effects are achieved equally well when the early portion of the repressurization cycle is by non-condensable gas injection rather than with steam, and less steam and time are required to achieve the improvement. It is not necessarily represented hereby, however, that these are the only or even the principal mechanisms operating during the employment of the process of our invention, and other mechanisms may be operative in the practice thereof which are responsible for a significant portion or even the major portion of the benefits resulting from application of this process.

FIELD EXAMPLE

The following field example is supplied for the purpose of additional disclosure and particularly illustrating a preferred embodiment of the application of the process of our invention, but it is not intended to be in any way limitative or restrictive of the process described herein.

The tar sand deposit is located under an overburden thickness of 500 feet, and the tar sand deposit is 85 feet thick. Two wells are drilled through the overburden and through the bottom of the tar sand deposit, the wells being spaced apart 80 feet apart. Both wells are completed in the bottom 5-foot section of the tar sand deposit and a gravel pack is formulated around the slotted liner on the end of the production tubing in the production well, while only a slotted liner on the end of tubing is used on the injection well.

The output of an air compressor is connected to the injection well and air is injected thereinto at an initial rate of about 250 standard cubic feet per hour, and this rate is maintained until evidence of air production is obtained from the production well. The air injection rate is thereafter increased gradually until after about eight days, the air injection rate of 1,000 standard cubic feet of air per hour is attained, and this air injection rate is maintained constant for 48 hours to ensure the establishment of an adequate air-swept zone in the formation.

An optional preheating step is applied before the first cycle of the process of my invention, in which eighty-five percent quality steam is injected into the injection well to pass through the air-swept zone, for the purpose of further increasing the permeability of the zone and heating the communication path between the injection well and production well. The injection pressure is initially 350 pounds per square inch, and this pressure is increased over the next five days to about 475 pounds per square inch, and maintained constant at this rate for two weeks. Bitumen is recovered from the production well, together with steam condensate. All of the liquids are removed to the surface of the earth, since it was desirable to maintain steam flow through the formation on a throughput, unthrottled basis in the initial stage of the process for the purpose of establishing a heated, stable communication path between the injection well and production well. The steam serves to heat and mobilize bitumen in the previously air-swept zones, and the mobilized bitumen is displaced toward the production well and then transported to the surface of the earth. Removal of bitumen from the air-swept portion of the formation reduces the bituminous petroleum saturation therein and therefore increases the permeability of a zone of the formation of the lower portion thereof and maintains continuity between the injection well and the production well. In addition, the communication zone is heated by passing steam therethrough which is a desirable preliminary step to the application of the subsequently described process of this invention.

After approximately two months of steam injection without any form of fluid flow restraint from the production well, it is determined that an adequately stable, heated communication path has been established. Steam is being injected into the injection well at an injection pressure of 500 pounds per square inch. Flow of fluids from the production well is restricted by use of a 3/16 inch choke which ensures that the flow rate of fluids from the formation is less than about 40 barrels per day. This is less than 10 percent of the volume flow rate of steam into the injection well, which is 450 barrels per day. Pressure at the production well rises gradually over a four month period until it approaches 400 pounds per square inch, and a minor amount of live steam is being produced at the production well, which verifies that the end of the second phase of the first cycle of the process of this invention has been reached.

In order to accomplish the pressure depletion portion of the pressurization-depletion cycle of the process of this invention, the steam injection pressure is reduced to about 250 pounds per square inch, which effectively reduces the flow rate of steam and hydrocarbon into the injection well to about 40 barrels per day, which is less than 10 percent of the original volume injection rate. At the same time, the choke is removed from the production well and fluid flow therefrom is permitted without any restriction at all. The fluid being produced from the production well is a mixture of essentially "free" bitumen, comprising bitumen with only a minor portion of water emulsified therein, and oil-in-water emulsion. The oil-in-water emulsion represents approximately 80 percent of the total fluid recovered from the well, and the free bitumen is easily separated from the oil-in-water emulsion. The oil-in-water emulsion is then treated with chemicals to resolve it into a relatively water-free bituminous petroleum phase and water. The water is then treated and recycled into the steam generator.

Production of fluids under these conditions is continued until the flow rate diminishes to a value of about 15 percent of the original flow rate at the start of this depletion cycle, which indicates that the maximum drawdown effect has been accomplished. This requires approximately 120 days.

The choke is reinstalled in the production well, and nitrogen injection is initiated into the injection well. Essentially pure commercial grade nitrogen is injected at a pressure of approximately 500 pounds per square inch and the pressure in the portion of the formation adjacent the injection well is monitored during this injection phase. Since it is desired that the pressure in the formation reach a final value of about 500 pounds per square inch, nitrogen injection is continued until it is determined that the pressure has risen to a value of about 400 pounds per square inch. This requires the injection of approximately 0.05 pore volumes of nitrogen into the portion of the formation affected by the injection well.

After the partial pressurization by inert gas injection has been completed, gas injection is terminated and essentially pure steam of approximately 75% quality is injected into the formation. During both the inert gas injection and steam injection, production is maintained at a throttled rate as described above and steam injection continues until the temperature of the fluid being produced from the formation rises to a value of about 450° F. (232° C.), indicating that live steam production will begin quite soon. Another drawdown cycle is then applied, which accomplishes production of fluid and reduction of pressure in the formation. This is continued until the production rate has dropped to a value which is about 40 percent of the original injection rate at which steam was injected into the formation. The formation is produced by applying a series of cycles comprising partial repressurization with inert gas followed by final repressurization with steam with restricted production to increase the pressure of the formation, followed by reduction in steam injection rate and increase in fluid production rate in order to accomplish pressure drawdown of the formation. As a consequence of application of the process of this invention to the formation, approximately 85 percent of the bitumenous petroleum present in the recovery zone defined by the wells employed in this pilot test are recovered.

Thus it has been disclosed and demonstrated how the oil recovery efficiency of a thermal oil recovery process may be dramatically improved by utilization of series of cycles, comprising injecting steam at a high rate into the formation with fluid flow being restricted substantially, followed by virtually unrestricted fluid flow from the production well and substantially reduced steam injection, for purposes of drawdown of formation pressure, followed by a plurality of cycles comprising partially repressuring with inert gas, then final pressurization with steam and a pressure drawdown production cycle.

While our invention has been described in terms of a number of specific illustrative embodiments, it should be understood that it is not so limited since numerous variations thereover will be apparent to persons skilled in the art of oil recovery from viscous oil formations without departing from the true spirit and scope of our invention. It is our intention and desire that our invention be limited only by those restrictions or limitations as are contained in the claims appended immediately hereinafter below.

We claim:

1. A method for recovering viscous petroleum from a subterranean, viscous petroleum-containing, permeable formation including a tar sand deposit, said formation being penetrated by at least one injection well and by at least one production well, comprising:

(a) injecting into the formation via the injection well, a thermal recovery fluid comprising steam at an injection pressure less than the fracture pressure of the overburden above the viscous petroleum formations, and at a determinable flow rate, while restricting the flow rate of fluids from the production well to a value less than the rate at which fluids are being injected into the injection well, in order to increase the pressure in the formation;

(b) determining the formation pressure in the vicinity of the production well;

(c) continuing injecting said thermal recovery fluid into the injection well and producing fluids from the production well at a restricted value until the formation pressure adjacent the production well rises to a predetermined value;

(d) thereafter increasing the rate of fluid production from the formation via the producing well to the maximum safe value and simultaneously reducing the injection rate of thermal recovery fluid into the injection well to a value which is less than 50 percent of the original rate at which thermal recovery fluid was injected into the injection well, until the flow rate of fluids from the production well drops to a value below 50 percent of the initial fluid production flow rate;

(e) injecting a noncondensable gas into the formation via the injection well at a pressure less than the overburden fracture pressure while restricting the flow rate of fluids from the production well to a value less than the rate at which gas is being injected into the formation until the pressure in the formation adjacent the production well is from 50 to 90 percent of the predetermined pressure of step (c);

(f) thereafter discontinuing injecting noncondensable gas and injecting a thermal recovery fluid comprising steam into the formation while restricting production from the formation via the production well to a value less than the steam injection rate in order to increase the pressure in the formation adjacent to the production well to a predetermined value;

(g) thereafter increasing the rate of fluid production from the formation via the production well to the maximum safe value and simultaneously reducing the rate of injecting thermal recovery fluid to a value less than 50 percent of the original injection rate at which the thermal recovery fluid was injected and less than the production rate until the flow rate of fluids from the production wells drops to a value below 50 percent of the initial fluid production flow rate of this step.

2. A method as recited in claim 1 comprising the additional step of injecting a heating fluid comprising steam into the formation via the injection well and recovering fluids from the formation via the production well until live steam is produced from the production well, without restricting flow rate of fluids from the formation, prior to step (a).

3. A method as recited in claim 1 wherein steps (e), (f) and (g) are repeated at least once.

4. A method as recited in claim 1 wherein the thermal recovery fluid is steam.

5. A method as recited in claim 1 wherein the thermal recovery fluid is a mixture of steam and from 2 to 40 percent of a $C_3$ to $C_{12}$ hydrocarbon.

6. A method as recited in claim 5 wherein the hydrocarbon is selected from the group consisting of propane, butane, pentane, hexane, heptane, octane, nonane, decane, undecane, dodecane, natural gasoline, naphtha, kerosene and mixtures thereof.

7. A method as recited in claim 1 wherein the thermal recovery fluid is a mixture of steam and a free oxygen containing gas including air, the ratio of gas to steam being from 0.05 to 0.65 thousand standard cubic feet of gas per barrel of steam as water.

8. A method as recited in claim 1 wherein noncondensable gas injection is continued until the pressure of the formation rises to a value which is from 60 to 80 percent of the predetermined formation pressure.

9. A method as recited in claim 1 wherein thermal recovery fluid of step (c) is injected into the formation until the pressure adjacent the production well rises to a value from 60 to 95 percent of the fluid injection pressure at the injection well.

10. A method as recited in claim 1 wherein production of fluid from the production well in steps (c) is maintained at a value less than 20 percent of the rate at which the thermal recovery fluid is being injected into the injection well.

11. A method as recited in claim 1 wherein the noncondensable gas is selected from the group consisting of nitrogen, air, hydrogen, carbon dioxide, $C_1$ to $C_3$ normally gaseous hydrocarbons, natural gas, exhaust gas, flue gas, and mixtures thereof.

12. A method as recited in claim 11 wherein the gas is nitrogen.

13. A method for recovering viscous petroleum from a subterranean, viscous petroleum-containing, permeable formation including a tar sand deposit, said formation being penetrated by at least one injection well and by at lfluid comprising steam at an injection pressure less than the fracture pressure of the overburden above the viscous petroleum formations, and at a determinable flow rate, while restricting the flow rate of fluids from the production well to a value less than the rate at which fluids are being injected into the injection well, in order to increase the pressure in the formation;

(b) determining the temperature of the fluid being produced at the production well;

(c) continuing injecting said thermal recovery fluid into the injection well and producing fluids from the production well at a restricted value until the produced fluid temperature reaches a predetermined value;

(d) thereafter increasing the rate of fluid production from the formation via the producing well to the maximum safe value and simultaneously reducing the injection rate of thermal recovery fluid into the injection well to a value which is less than 50 percent of the original rate at which thermal recovery fluid was injected into the injection well, until the flow rate of fluids from the production well drops to a value below 50 percent of the initial fluid production flow rate;

(e) injecting a noncondensable gas into the formation via the injection well at a pressure less than the overburden fracture pressure until the pressure in the formation adjacent the injection well is from 50 to 90 percent of the predetermined pressure of step (c);

(f) thereafter discontinuing injecting noncondensable gas and injecting a thermal recovery fluid comprising steam into the formation while restricting production from the formation via the production well to a value less than the steam injection rate in order to increase the pressure in the formation until the produced fluid temperature rises to a predetermined value;

(g) thereafter increasing the rate of fluid production from the formation via the production well to the maximum safe value and simultaneously reducing the rate of injecting thermal recovery fluid to a value less than 50 percent of the original injection rate at which the thermal recovery fluid was injected and less than the production rate until the flow rate of fluids from the production wells drops to a value below 50 percent of the initial fluid production flow rate of this step.

14. A method as recited in claim 13 comprising the additional step of injecting a heating fluid comprising steam into the formation via the injection well and recovering fluids from the formation via the production well until live steam is produced from the production well, without restricting flow rate of fluids from the formation, prior to step (a).

15. A method as recited in claim 13 wherein steps (e), (f) and (g) are repeated at least once.

16. A method as recited in claim 13 wherein the noncondensable gas is nitrogen.

17. A method for recovering viscous petroleum from a subterranean, viscous petroleum-containing, permeable formation including a tar sand deposit, said formation being penetrated by at least one injection well and by at least one production well, comprising:

(a) injecting into the formation via the injection well, a thermal recovery fluid comprising steam at an injection pressure less than the fracture pressure of the overburden above the viscous petroleum formations, and at a determinable flow rate, while restricting the flow rate of fluids from the production well to a determinable flow rate less than the rate at which fluids are being injected into the injection well, in order to increase the pressure in the formation;

(b) continuing injecting said thermal recovery fluid into the injection well and producing fluids from the production well at a restricted value until the fluid being produced from the formation via the production well includes vapor phase steam;

(c) thereafter increasing the rate of fluid production from the formation via the producing well to the maximum safe value and simultaneously reducing the rate of injecting thermal recovery fluid to a value less than 50 percent of the original rate at which the thermal recovery fluid was injected and less than the production rate until the flow rate of fluids from the production wells drops to a value below 50 percent of the initial fluid production flow rate of this step;

(d) injecting a noncondensible gas into the formation via the injection well at a pressure less than the overburden fracture pressure while restricting the flow rate of fluids from the production well to a value less than the rate at which noncondensible gas is being injected into the formation until the pressure in the formation adjacent the production well rises to a value which is from 50 to 90 percent of the gas injection pressure;

(e) thereafter discontinuing injecting noncondensible gas and injecting a thermal recovery fluid comprising steam into the formation while restricting the flow rate of fluid from the production well to a value less than the rate at which the thermal recovery fluid is being injected into the injection well, in order to increase the pressure in the formation until the fluid being produced includes vapor phase steam;

(f) thereafter increasing the rate of fluid production from the formation via the producing well to the maximum same value and simultaneously reducing the rate of injecting thermal recovery fluid to a value less than 50 percent of the original rate at which the thermal recovery fluid was injected and less than the production rate in order to reduce the pressure in the formation, until the flow rate of fluids from the production well drops to a value which is less than 50 percent of the initial fluid production flow rate from the production well.

18. A method as recited in claim 17 comprising the additional step of injecting a heating fluid comprising steam into the formation via the injection well and recovering fluids from the formation via the production well until live steam is produced from the production well, without restricting flow rate of fluids from the formation, prior to step (a).

19. A method as recited in claim 17 wherein steps (d), (e) and (f) are repeated at least once.

20. A method as recited in claim 17 wherein the noncondensable gas is nitrogen.

* * * * *